US006425366B1

(12) United States Patent
Ogawa et al.

(10) Patent No.: US 6,425,366 B1
(45) Date of Patent: Jul. 30, 2002

(54) CONTROL SYSTEM FOR INTERNAL COMBUSTION ENGINE

(75) Inventors: Ken Ogawa; Isao Komoriya; Shuji Nagatani, all of Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 27 days.

(21) Appl. No.: 09/655,508

(22) Filed: Sep. 5, 2000

(30) Foreign Application Priority Data

Sep. 6, 1999 (JP) ..... 11-252118

(51) Int. Cl.[7] ..... F02D 41/00; F02B 17/00
(52) U.S. Cl. ..... 123/295; 123/430; 123/305
(58) Field of Search ..... 123/295, 305, 123/478, 480, 430, 435, 486

(56) References Cited

U.S. PATENT DOCUMENTS 5,078,107 A * 1/1992 Morikawa ..... 123/295
5,937,822 A * 8/1999 Nakajima ..... 123/295
5,967,114 A * 10/1999 Yasuoka ..... 123/295
6,006,717 A * 12/1999 Suzuki et al. ..... 123/295
6,142,117 A * 11/2000 Hori et al. ..... 123/295

* cited by examiner

*Primary Examiner*—John Kwon
*Assistant Examiner*—Hieu T. Vo
(74) *Attorney, Agent, or Firm*—Arent Fox Kintner Plotkin & Kahn, PLLC

(57) ABSTRACT

There is provided a control system for an internal combustion engine which controls the operation of the engine such that the combustion mode of the engine is switched between a stratified combustion mode and a homogeneous combustion mode, and torque generated by the engines is controlled based on a desired torque. The control system has an ECU which calculates a required torque based on results of detection by a crack angle position sensor and an accelerator pedal sensor, and determines a combustion mode according to the required torque. Further, the ECU smoothes the required torque in dependence on the combustion mode, to thereby calculate a smoothed required torque. Then, ECU sets the desired torque based on the smoothed required torque.

6 Claims, 3 Drawing Sheets

CONTROL SYSTEM FOR INTERNAL COMBUSTION ENGINE

BACKGROUND OF THE INVENTION

1. Field of the Invention

This invention relates to a control system for an internal combustion engine, and more particularly to a control system for an in-cylinder direct injection internal combustion engine, which controls the operation of the engine such that the combustion mode of the engine is switched between a stratified combustion mode for performing stratified combustion of an air-fuel mixture, and a homogeneous combustion mode for performing homogeneous combustion of the air-fuel mixture, and that torque generated by the engine is controlled based on a desired torque.

2. Description of the Prior Art

Conventionally, a control system for an internal combustion engine, of the above-mentioned kind, was proposed e.g. in Japanese Laid-Open Patent Publication (Kokai) No. 10-103118. This internal combustion engine is installed on an automotive vehicle and includes two kinds of fuel injection valves, one for use in stratified combustion and the other for use in homogeneous combustion. Fuel injection valves for stratified combustion are each mounted in a cylinder head for a corresponding one of cylinders such that fuel is directly injected into a combustion chamber of the corresponding cylinder. Further, a fuel injection valve for homogeneous combustion is mounted in an intake pipe at a location upstream of a throttle valve such that fuel is injected into the intake pipe.

The control system controls the operation of the internal combustion engine such that the combustion mode of the engine is switched between a stratified combustion mode selected when the engine is in a low-load operating condition, and a homogeneous combustion mode selected when the engine is in a high-load operating condition, and that the amount of fuel controlled thereby is injected from the fuel injection valves for homogeneous combustion and stratified combustion to generate a required torque. More specifically, the control system determines as the required torque a total desired injection amount of fuel to be injected from the two kinds of fuel injection valves, based on operating conditions (engine rotational speed, accelerator pedal opening, etc.) of the engine, compares the total desired injection amount with a threshold, and switches the combustion mode between the stratified combustion mode and the homogeneous combustion mode according to results of the comparison.

In the homogeneous combustion mode, fuel injection is carried out by using the two kinds of fuel injection valves, and a desired fuel injection amount (hereinafter referred to as "the homogeneous desired injection amount") to be injected from the fuel injection valve for homogeneous combustion, and a desired fuel injection amount (hereinafter referred to as "the stratified desired injection amount") to be injected from one of the fuel injection valves for stratified combustion are determined in the following manner: A correction coefficient is determined based on operating conditions of the engine to multiply the total desired injection amount by the correction coefficient, and the resulting product of the multiplication is set to the homogeneous desired injection amount. Further, based on the homogeneous desired injection amount calculated this time and a smoothing value (averaging value) calculated last time, a present smoothing value is calculated, and a difference calculated by subtracting the present smoothing value from the total desired injection amount is set to the stratified desired injection amount. In the homogeneous combustion mode, the homogeneous desired injection amount and the stratified desired injection amount are set as described above.

On the other hand, in the stratified combustion mode, the homogeneous desired injection amount is set to "0" and the stratified desired injection amount is set to a difference calculated by subtracting the present smoothing value from the total desired injection amount, whereby fuel injection is carried out only by using the fuel injection valve for stratified combustion. When the operating condition of the engine becomes stable after the combustion mode is switched from the homogenous combustion mode to the stratified combustion mode, the smoothing value becomes almost equal to "0", so that the total desired injection amount is set to the stratified desired injection amount, without any substantial subtraction.

In the control system constructed as above, when the total desired injection amount is increased with an increase in the required torque, the combustion mode of the engine is switched from the stratified combustion mode to the homogeneous combustion mode. As described above, the fuel injection valve for homogeneous combustion is located farther from the combustion chamber than the fuel injection valves for stratified combustion are, so that when the stratified combustion mode is switched to the homogeneous combustion mode, fuel from the fuel injection valve for homogeneous combustion is supplied to the combustion chambers with some delay, i.e. later than fuel from the fuel injection valves for stratified combustion. To eliminate this inconvenience, the homogeneous desired injection amount and the stratified desired injection amount are calculated, as described above, such that the stratified desired injection amount is increased by an amount of fuel corresponding to the above delay. This makes it possible to prevent the air-fuel ratio of an air-fuel mixture supplied to the engine and the output torque generated by combustion of the mixture from being largely changed upon switching of the combustion mode from the stratified combustion mode to the homogeneous combustion mode. Similarly, when the homogeneous combustion mode is switched to the stratified combustion mode in response to a decrease in the required torque, fuel is injected in the stratified desired injection amount which is the difference calculated by subtracting the smoothing value from the total desired injection amount, whereby a large change in the air-fuel ratio can be prevented.

According to the conventional control system, it is possible to prevent a large change in the air-fuel ratio when the combustion mode is switched between the stratified combustion mode and the homogeneous combustion mode, as described above. However, when the engine enters a relatively stable operating condition with the lapse of a transitional time period after the combustion mode is switched e.g. to the homogeneous combustion mode, there no longer occur significant changes in the total desired injection amount or the homogeneous desired injection amount, and the smoothing value also becomes almost constant, so that the smoothing does not produce almost any effect. Similarly, the stratified desired injection amount also ceases to undergo any significant change. For this reason, an actual sum-total desired injection amount which is the sum total of the homogeneous desired injection amount and the stratified desired injection amount both finally determined and injected respectively from the two kinds of fuel injection valves becomes almost identical to the total desired injection amount calculated based on operating conditions of the engine. As a result, the sum-total desired injection amount for actual injection comes to be sensitively changed in response to a slight change in the required torque, e.g. a subtle change in the engine rotational speed or the accelerator pedal opening, so that the air-fuel ratio is too sensitively changed, resulting in degraded drivability. Further, when a transitional time period has elapsed after the combustion mode is switched to the stratified combustion mode, the smoothing value becomes almost equal to "0", so that the total desired injection amount is directly set to the stratified desired injection amount. Therefore, when a subtle change occurs in the required torque, the air-fuel ratio is sensitively changed in direct response to the subtle change, thereby causing the same problem as in the homogeneous combustion mode.

SUMMARY OF THE INVENTION

It is an object of the invention to provide a control system for an internal combustion engine which controls the operation of the engine such that the combustion mode of the engine is switched between a stratified combustion mode and a homogeneous combustion mode, and that there can be ensured stability of the air-fuel ratio of an air-fuel mixture supplied to the engine in response to subtle changes in required torque, thereby enhancing drivability.

To attain the above object, the present invention provides a control system for an in-cylinder direct injection internal combustion engine, which controls an operation of the engine such that a combustion mode of the engine is switched between a stratified combustion mode for performing stratified combustion of an air-fuel mixture, and a homogeneous combustion mode for performing homogeneous combustion of the air-fuel mixture, and that torque generated by the engine is controlled based on a desired torque.

The control system according to the invention is characterized by comprising:

operating condition detection means for detecting operating conditions of the engine;

required torque calculation means for calculating a required torque based on results of detection by the operating condition detection means;

combustion mode determination means for determining which of the stratified combustion mode and the homogeneous combustion mode should be set to the combustion mode, according to the required torque;

smoothed required torque calculation means for calculating a smoothed required torque by smoothing the calculated required torque, in dependence on the determined combustion mode; and desired torque-setting means for setting the desired torque based on the calculated smoothed required torque.

According to this control system, a required torque is calculated based on operating conditions of the internal combustion engine, and the combustion mode of the engine is set to either the stratified combustion mode or the homogeneous combustion mode according to the required torque. Further, a smoothed required torque is calculated by smoothing the calculated required torque in dependence on the combustion mode determined, and a desired torque for use in carrying out the torque control is set based on the smoothed required torque. As described above, in each of the stratified combustion mode and the homogeneous combustion mode, the torque control is executed based on the smoothed required torque which is obtained by smoothing the required torque, so that differently from the conventional control system, even, when there occurs a subtle change in the required torque, it is possible to ensure stability of the air-fuel ratio of an air-fuel mixture supplied to the engine while preventing the air-fuel ratio from being adversely affected by the change in the required torque. This results in enhanced drivability. Further, for the same reason, it is possible to carry out the torque control while preventing noises in outputs from the operating condition detection means from adversely affecting the torque control.

Preferably, the required torque is smoothed to a greater degree when the combustion mode of the engine is set to the stratified combustion mode than when the combustion mode of the engine is set to the homogeneous combustion mode.

Generally, when the engine is in the stratified combustion mode, the air-fuel ratio of the mixture is controlled to a far leaner value than when the engine is in the homogeneous combustion mode, so that it is necessary to operate air intake devices, such as a throttle valve and an EGR (exhaust gas recirculation) valve, and further, the air-fuel ratio is more sensitively responsive to subtle changes in the required torque when the engine is in the stratified combustion mode, which necessitates more accurate control of the air-fuel ratio. According to the preferred embodiment, in the stratified combustion mode, the required torque is smoothed to a greater degree than in the homogeneous combustion mode, and hence it is possible to further enhance the stability of the air-fuel ratio while preventing the air-fuel ratio from being adversely affected by the subtle change in the required torque.

More preferably, the smoothing is carried out by calculating an average value of a predetermined number of values of the required torque calculated up to this time, the predetermined number being set to a larger value when the combustion mode of the engine is set to the stratified combustion mode than when the combustion mode of the engine is set to the homogeneous combustion mode.

Preferably, when a load on the engine is outside a predetermined range, the desired torque-setting means sets the desired torque based on the required torque instead of the smoothed required torque.

Preferably, the operating condition detection means includes at least one of an engine rotational speed sensor for detecting a rotational speed of the engine and an accelerator pedal sensor for detecting a degree of accelerator pedal opening.

Preferably, the engine includes a plurality of cylinders, and a plurality of fuel injection valves each permitting injection of fuel into a combustion chamber of a corresponding one of the cylinders, and the combustion mode of the engine is switched between the stratified combustion mode and the homogeneous combustion mode by changing timing of the injection of the fuel into the combustion chamber.

The above and other objects, features, and advantages of the invention will become more apparent from the following detailed description taken in conjunction with the accompanying drawings.

DETAILED DESCRIPTION

Figure 1:
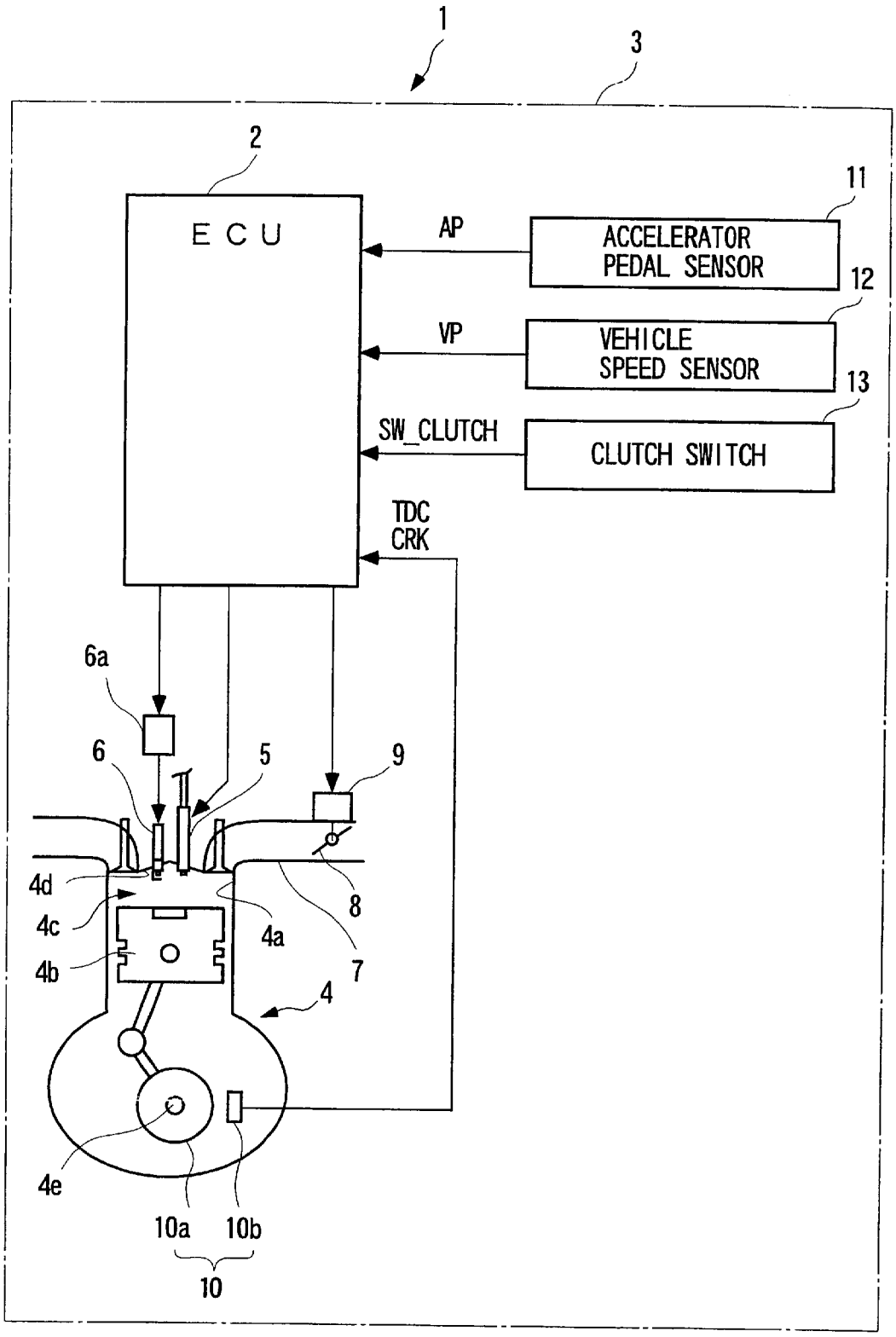
FIG. 1 is a block diagram schematically showing the arrangement of a control system for an internal combustion engine, according to an embodiment of the invention.

The invention will now be described in detail with reference to the drawings showing an embodiment thereof. Referring first to FIG. 1, there is schematically shown the arrangement of a control system for an internal combustion engine, according to an embodiment of the invention. As shown in the figure, the control system 1 includes an ECU 2 (operating condition detection means, required torque calculation means, combustion mode determination means, smoothed required torque calculation means, desired torque-setting means). As described in detail hereinafter, the ECU 2 carries out torque control, ignition timing control, air-fuel ratio control, etc. of an internal combustion engine (hereinafter referred to as "the engine") 4 installed on an automotive vehicle 3. The automotive vehicle 3 is a manual transmission vehicle (MT vehicle) which includes a manual transmission system, a clutch, a clutch pedal, and an accelerator pedal, none of which are shown.

The engine 4 is a straight type four-cylinder gasoline engine including cylinders 4*a* and pistons 4*b* (only one of the cylinders 4*a* and a corresponding one of the pistons 4*b* are shown in the figure). Between the piston 4*b* and a cylinder head 4*d,* there is formed a combustion chamber 4*c*. Further, the cylinder head 4*d* has a fuel injection valve (hereinafter simply referred to as "the injector") 5 as a fuel supply device and a spark plug 6 mounted therein such that they are inserted into the combustion chamber 4*c*. The engine 4 is an in-cylinder direct injection engine in which fuel is directly injected into the combustion chamber 4*c*. The injector 5 is connected to the ECU 2 such that a fuel injection time period over which the injector 5 injects fuel and a fuel injection timing at which the same injects fuel are controlled in response to a drive signal delivered from the ECU 2. Further, the spark plug 6 is also connected to the ECU 2, and a high voltage is applied to the spark plug 6 via an ignition coil 6*a,* at an ignition timing indicated by a drive signal delivered from the ECU 2, for electric discharge, whereby an air-fuel mixture is burned in the combustion chamber 4*c*.

The ECU 2 controls the operation of the engine 4 such that the combustion mode thereof is switched between a stratified combustion mode and a homogeneous combustion mode, by controlling the fuel injection time period and fuel injection timing of the injector 5 and the ignition timing of the spark plug 6 in dependence on an operating condition of the engine 4. More specifically, the stratified combustion mode is executed mainly during low-load operation of the engine 4, such as idling, and in this mode, fuel is injected into the combustion chamber 4*c* through the injector 5 during a second half of a compression stroke to cause a very lean air-fuel mixture to be unevenly distributed in the combustion chamber or concentrated in the vicinity of the spark plug 6, and the mixture is burned by stratified combustion. On the other hand, the homogeneous combustion mode is carried out mainly during high-load operation of the engine 4, and in this mode, fuel is injected into the combustion chamber 4*c* through the injector 5 during a first half of an intake stroke to cause a richer air-fuel mixture to be homogeneously distributed in the combustion chamber 4*c* than in the stratified combustion mode, and the mixture is burned by homogeneous combustion.

Arranged in an intermediate portion of an intake pipe 7 of the engine 4 is a throttle valve 8 which is connected to a stepping motor 9. The stepping motor 9 is electrically connected to the ECU 2 and changes a throttle valve opening θTH which is a degree of opening of the throttle valve 8 in response to a drive pulse signal from the ECU 2, whereby the amount of intake air supplied to the combustion chamber 4*c* through the intake pipe 7 is adjusted.

The engine 4 has a crankshaft 4*e* to which is mounted a magnet rotor 10*a* forming a crank angle position sensor 10 together with an MRE (magnetic resistance element) pickup 10*b*. The crank angle position sensor 10 as rotational speed detection means delivers a CRK signal and a TDC signal, which are both pulse signals, in accordance with rotation of the crankshaft 4*e*. The CRK signal is indicative of a sensed rotational angle position of the crankshaft 4*e,* and each pulse of the CRK signal (CRK signal pulse) is generated at each of predetermined crank angle positions whenever the crankshaft 4*e* rotates through a predetermined angle (e.g. one degree). The ECU 2 determines a rotational speed NE of the engine 4 (hereinafter referred to as "the engine rotational speed NE"), based on the CRK signal. On the other hand, each pulse of the TDC signal (TDC signal pulse) indicates that the piston 4*b* in each cylinder 4*a* of the engine 4 is in the vicinity of a top dead center position at the start of an intake stroke of the piston 4*b,* and is generated whenever the crankshaft 4*e* rotates through 180 degrees in the case of the four-cylinder type engine according to the embodiment.

Further, the ECU 2 is connected to an accelerator pedal sensor 11 (operating condition detection means), a vehicle speed sensor 12, and a clutch switch 13. The accelerator pedal sensor 11 detects an operation amount or stepping amount AP of the accelerator pedal (hereinafter referred to as "the accelerator pedal opening AP"). The vehicle speed sensor 12 is provided for detecting a vehicle speed VP which is a traveling speed,of the automotive vehicle 3. The vehicle speed sensor 12 is comprised of a magnet rotor, not shown, attached to an axle of the automotive vehicle 3, and an MRE pickup, not shown. The clutch switch 13 detects a state of engagement or disengagement of the clutch, and an output value SW_CLUTCH therefrom assumes "0" when the clutch pedal is stepped on by an amount equal to or larger than a predetermined amount to disengage the clutch, whereas when the clutch pedal is not stepped on, and the clutch is not disengaged, the output value assumes "1".

Further, the ECU 2 is formed by a microcomputer including a CPU, a RAM, a ROM, and an I/O interface, none of which are shown. The signals from the sensors 10 to 12 and the switch 13 are each delivered to the ECU 2, and after A/D conversion and waveform shaping in the I/O interface, they are inputted to the CPU. The CPU carries out arithmetic operations in response to these signals, by executing control programs read from the ROM, and using values of flags and computational values, referred to hereinafter, stored in the RAM. More specifically, as described hereinbelow, the ECU 2 performs a desired torque-setting process, and drives the stepping motor 9 according to a value of a desired torque PMCMDREG determined by the desired torque-setting process, thereby controlling the throttle valve opening θTH. At the same time, the ECU 2 determines based on operating conditions of the engine 4 which of the stratified combustion mode and the homogeneous combustion mode the engine 4 should be set to the combustion mode of the engine 4. Then, the ECU 2 calculates the fuel injection time period and the fuel injection timing as well as the ignition timing, and delivers drive signals dependent on the results of the calculations to the injector 5 and the spark plug 6, via the output interface. Thus, the ECU 2 controls the fuel injection time period and fuel injection timing of the injector 5 and the ignition timing of the spark plug 6, thereby switching the combustion mode of the engine 4 between the stratified combustion mode and the homogeneous combustion mode.

Figure 2:
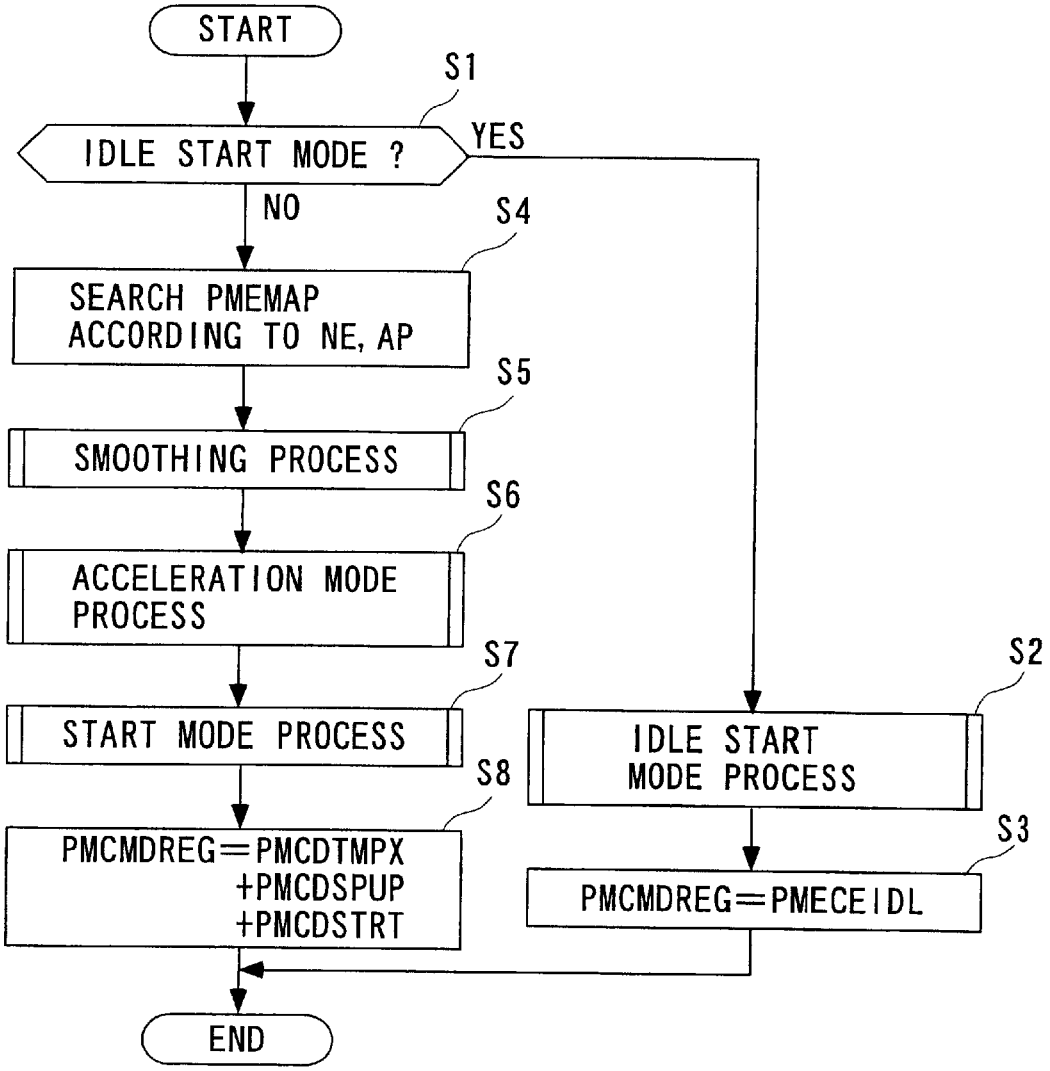
FIG. 2 is a flowchart showing a routine for carrying out a desired torque-setting process, which is executed by the control system.

In the following, the desired torque-setting process carried out by the ECU 2 for setting the desired torque PMCMDREG will be described with reference to FIGS. 2 and 3. FIG. 2 shows a main routine for setting the desired torque PMCMDREG, which is executed byan interrupt handling routine at predetermined time intervals (e.g. every 100 msec.) according to the settings of a program timer.

As shown in the figure, in the process, first, it is determined at a step S1 whether or not the engine 4 is in an idle start mode which starts the automotive vehicle 3 from an idling condition only by engaging the clutch. The determination at the step S1 is carried out based on whether or not there are satisfied all the following conditions: the engine 4 is idling, the vehicle,: speed VP is equal to or lower than a predetermined vehicle speed X_VPIST (e.g. 5 km/h), the output value SW_CLUTCH from the clutch switch 13 is equal to "0", that is, the clutch pedal is stepped on, and the engine rotational speed NE is equal to or lower than a predetermined rotational speed NEIDST (e.g. 500 rpm) lower than a normal idling rotational speed.

If the answer to the question of the step S1 is affirmative (Yes), i.e. if the engine 4 is in the idle start mode, the program proceeds to a next step S2, wherein an idle start mode process is carried out. Although detailed description of the idle start mode process is omitted, in this process, an idle starting-time required torque PMECEIDL is set to the required torque according to the engine rotational speed NE, and the drive mode of the engine 4 is set to the homogeneous combustion mode using a stoichiometric fuel-air ratio. Then, the idle starting-time required torque PMECEIDL set at the step S2 is set to the desired torque PMCMDREG at a step S3, followed by terminating the program. This loop prevents occurrence of an engine stall when the engine 4 is started in the idle start mode, and ensures toughness of the air-fuel ratio control in starting the engine 4 after termination of the idle start mode.

On the other hand, if the answer to the question of the step S1 is negative (No), i.e. if the engine 4 is not in the idle start mode, the program proceeds to a step S4, wherein a required torque PMEMAP is calculated according to the present engine rotational speed NE and accelerator pedal opening AP by referring to an NE-AP-PMEMAP map, not shown, and then the required torque PMEMAP thus calculated stored in the RAM.

Next, the program proceeds to a step S5, wherein a smoothing process for smoothing the required torque, according to the present invention, is carried out. FIG. 3 shows a subroutine for executing the smoothing process. As shown in the figure, in the smoothing process, first, it is determined at a step S50 whether or not the present combustion mode is the stratified combustion mode. It should be noted that the determination of the combustion mode is carried out by referring to the required torque PMEMAP which has been obtained at the step S4 in FIG. 2. If the answer to the question of the step S50 is affirmative (Yes), i.e. if it is determined that the present combustion mode is the stratified combustion mode, the program proceeds to a step S51, wherein a smoothing number NPMCDAVED (e.g. "30") for use in the stratified combustion mode is set to a smoothing number npmcdave (npmcdave=NPMCDAVED). This smoothing number npmcdave is used in determining a smoothed required torque PMCDTMPX at a step S58 referred to hereinafter.

On the other hand, if the answer to the question of the step S50 is negative (No), i.e. if it is determined that the present combustion mode is the homogeneous combustion mode, the program proceeds to a step S52, wherein a smoothing number NPMCDAVEP (e.g. "15") for use in the homogeneous combustion mode is set to the smoothing number npmcdave (npmcdave=NPMCDAVEP). This smoothing number NPMCDAVEP for use in the homogeneous combustion mode is set to a value smaller than the above smoothing number NPMCDAVED for use in the stratified combustion mode (NPMCDAVEP<NPMCDAVED). This is because the air-fuel ratio of the mixture is controlled to a far leaner value in the stratified combustion mode than in the homogeneous combustion mode, and hence is more sensitively changed according to changes in the required torque PMEMAP, which necessitates more accuracy control of the air-fuel ratio.

Then, the program proceeds to a step S53, wherein it is determined whether or nor the engine rotational speed NE is equal to or lower than an upper limit value NEPMCDH (e.g. 3000 rpm). If the answer to the question of the step S53 is affirmative (Yes), i.e. if the engine rotational speed NE is equal to or lower than the upper limit value NEPMCDH, the program proceeds to a step S54, wherein it is determined whether or nor the engine rotational speed NE is equal to or higher than a lower limit value NEPMCDL (e.g. 500 rpm). If the answer to the question of the step S54 is affirmative (Yes), i.e. if the engine rotational speed NE is equal to or higher than the lower limit value NEPMCDL and equal to or lower than the upper limit value NEPMCDH (NEPMCDL≦NE≦NEPMCDH), the program proceeds to a step S55, wherein a smoothing operation enable flag f_pmflok is set to "1" so as to perform a smoothing operation (averaging operation), described hereinafter. It should be noted that the lower limit value NEPMCDL and the upper limit value NEPMCDH are set to respective values provided with hystereses.

On the other hand, if the answer to the question of the step S53 or S54 is negative (No), i.e. if NE>NEPMCDH or NE<NEPMCDL holds, the program proceeds to a step S56, wherein the smoothing operation enable flag f_pmflok is set to "0" so as to inhibit the smoothing operation. The reason why the smoothing operation is inhibited when the engine rotational speed NE is higher than the upper limit value NEPMCDH, or when the same is lower than the lower limit value NEPMCDL as described above, is that when the load placed on the engine 4 is fairly large or small, more excellent drivability can be ensured by using the required torque PMEMAP obtained at the step S4 without smoothing the same, in calculation of the desired torque PMCMDREG.

From the above step S55 or S56, the program proceeds to a step S57, wherein it is of determined whether or not the smoothing operation enable flag f_pmflok assumes "1". If the smoothing operation enable flag f_pmflok=1 holds, then, at a step S58, the smoothed required torque PMCDTMPX is calculated by carrying out the smoothing operation. More specifically, a smoothing number npmcdave of present and preceding values of the required torque PMEMAP obtained at the step S4 and stored in the RAM, including the present value PMEMAPn, are added up to obtain a sum total. Next, the sum total of these values of the required torque is divided by the smoothing number npmcdave to obtain an average value of the required torque, and this average value is set to the smoothed required torque PMCDTMPX (PMCDTMPX=(PMEMAPn+PMEMAPn−1+ . . . +PMEMAPn+1−npmcdave)/npmcdave), followed by terminating the present subroutine. As described above, in the stratified combustion mode, the smoothing number NPMCDAVED, which has been set to the smoothing number npmcdave for use in the stratified combustion mode at the step S51, is used, and a smoothing number NPMCDAVED of values of the required torque PMEMAP are averaged. On the other hand, in the homogeneous combustion mode, the smoothing number NPMCDAVEP for use in the homogeneous combustion mode, which has been set at the step S52 to a value smaller than the above smoothing number NPMCDAVED, is used, and a smoothing number NPMCDAVEP of values of the required torque PMEMAP are averaged.

On the other hand, if the smoothing operation enable flag f_pmflok=0 holds at the step S57, the program proceeds to a step S59, wherein without carrying out a smoothing operation, the present required torque PMEMAPn obtained at the step S4 in FIG. 2 is set to the smoothed required torque PMCDTMPX (PMCDTMPX=PMEMAPn), followed by terminating the present subroutine.

Figure 3:
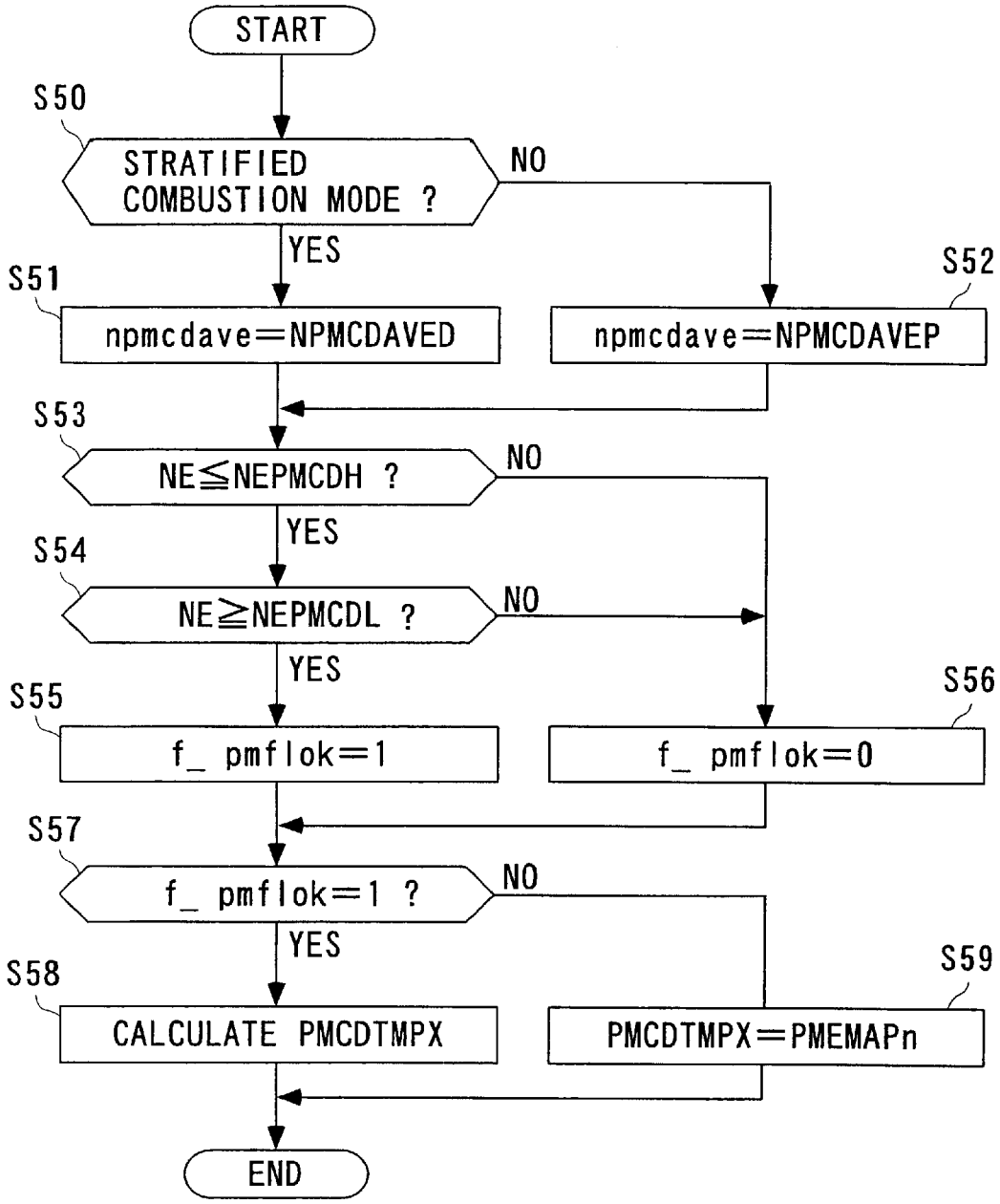
FIG. 3 is a flowchart showing a subroutine for carrying out a smoothing process.

After the FIG. 3 subroutine has been terminated, the program proceeds to a step S6 in FIG. 2, wherein an acceleration mode process is carried out. Although detailed description of the acceleration mode process is omitted, in this process, it is determined by utilizing a difference DPMSPUP between the present value PMEMAPn of the required torque obtained at the step S4 and the smoothed required torque PMCDTMPX obtained at the step S5 whether or not the engine 4 is in the acceleration mode. If the engine 4 is in the acceleration mode, a basic value PMEADD of an acceleration assistance amount PMCDSPUP is determined according to the difference DPMSPUP. Further, the basic value PMEADD is corrected in dependence on a speed position of the gear shift lever of the manual transmission system and a time period elapsed after being shifted to the acceleration mode, to thereby determine the acceleration assistance amount PMCDSPUP. As described hereinbelow, in setting the desired torque PMCMDREG, the acceleration assistance amount PMCDSPUP determined as above is added to the smoothed required torque PMCDTMPX, whereby the response of the engine 4 during acceleration is enhanced.

Next, a start mode process is carried out at a step S7 after the above acceleration mode process. Although detailed description of the start mode process is omitted, in this mode, when the clutch is engaged (SW_CLUTCH=1), and at the same time the vehicle speed VP is equal to or lower than the predetermined value, it is determined that the engine 4 is in the start mode, and further, a start assistance amount PMCMDSTRT is calculated based on the present values of the engine rotational speed NE and the accelerator pedal opening AP. In setting the desired torque PMCMDREG, as described hereinafter, the start assistance amount PMCMDSTRT thus determined is added to the smoothed required torque PMCDTMPX together with the acceleration assistance amount PMCDSPUP. This makes it possible to generate a torque sufficient to reflect the driver's intention and thereby prevent the vehicle from being slow in the start.

Then, at a step S8, the acceleration assistance amount PMCDSPUP obtained in the acceleration mode process at the step S6, and the start assistance amount PMCMDSTRT obtained in the start mode process at the step S7 are added to the smoothed required torque PMCDTMPX obtained in the smoothing process at the step S5, whereby the desired torque PMCMDREG is calculated (PMCMDREG=PMCDTMPX+PMCDSPUP+PMCMDSTRT), followed by terminating the desired torque-setting process.

As described hereinabove, according to the control system 1 of the present embodiment, the required torque PMEMAP is calculated based on the engine rotational speed NE and the accelerator pedal opening AP at the step S4 in FIG. 2, and depending on the required torque PMEMAP calculated this time, the combustion mode of the engine 4 is set to either the stratified combustion mode or the homogeneous combustion mode. Further, according to the combustion mode set as above, values of the required torque PMEMAP obtained at the step S5 (S58) are smoothed (averaged), whereby the smoothed required torque PMCDTMPX is calculated. Then, at the step S8, the desired torque PMCMDREG for use in carrying out the torque control is set based on the smoothed required torque PMCDTMPX.

As described above, in each of the stratified combustion mode and the homogeneous combustion mode, the torque control is executed based on the smoothed required torque PMCDTMPX which is obtained by smoothing or averaging present and preceding values of the required torque PMEMAP, so that differently from the conventional control system, even when there occur subtle changes in the required torque PMEMAP, it is possible to ensure stability of the air-fuel ratio while preventing the air-fuel ratio from being adversely affected by the changes in the required torque, which results in enhanced drivability. Further, for the same reason, it is possible to carry out the torque control while preventing noises in the outputs from the crank angle position sensor 10 and the accelerator pedal sensor 11 from adversely affecting the torque control.

Further, in general, the air-fuel ratio of the mixture is controlled to a far leaner value in the stratified combustion mode than in the homogeneous combustion mode, and hence is more sensitively changed according to changes in the required torque PMEMAP, which necessitates more accuracy control of the air-fuel ratio. According to the present embodiment, however, when the smoothed required torque PMCDTMPX is calculated at the step S58, if the engine 4 is in the stratified combustion mode, values of the required torque PMEMAP are averaged by applying, to the number of values used in the averaging, the smoothing number NPMCDAVED which is larger than the smoothing number NPMCDAVEP applied in the homogeneous combustion mode, so that it is possible to further enhance the stability of the air-fuel ratio while preventing the air-fuel ratio from being adversely affected by subtle changes in the required torque.

Although in the above-mentioned embodiment, the required torque PMEMAP is determined by searching the required torque map (NE-AP-PMEMAP map), not shown, according to the engine rotational speed NE and the accelerator pedal opening AP, this is not limitative, but the required torque PMEMAP may be determined according to another engine operation parameter (e.g. intake pipe absolute pressure PBA). Further, although in the above embodiment, the present invention is applied to an internal combustion engine installed on an automotive vehicle by way of example, this is not limitative, but the invention may be applied to any internal combustion engine so long as it is an in-cylinder direct injection internal combustion engine, including an internal combustion engine of this type installed on a motor cycle.

It is further understood by those skilled in the art that the foregoing is a preferred embodiment of the invention, and that various changes and modifications may be made without departing from the spirit and scope thereof.

What is claimed is:

1. A control system for an in-cylinder direct injection internal combustion engine, which controls an operation of said engine such that a combustion mode of said engine is switched between a stratified combustion mode for performing stratified combustion of an air-fuel mixture, and a homogeneous combustion mode for performing homogeneous combustion of said air-fuel mixture, and that torque generated by said engine is controlled based on a desired torque, the control system comprising:

operating condition detection means for detecting operating conditions of said engine;

required torque calculation means for calculating a required torque based on results of detection by said operating condition detection means;

combustion mode determination means for determining which of said stratified combustion mode and said homogeneous combustion mode should be set to said combustion mode, according to said required torque;

smoothed required torque calculation means for calculating a smoothed required torque by smoothing said required torque, in dependence on said determined combustion mode; and desired torque-setting means for setting said desired torque based on said calculated smoothed required torque.

2. A control system according to claim 1, wherein said required torque is smoothed to a greater degree when said combustion mode of said engine is set to said stratified combustion mode than when said combustion mode of said engine is set to said homogeneous combustion mode.

3. A control system according to claim 2, wherein said smoothing is carried out by calculating an average value of a predetermined number of values of said required torque calculated up to this time, said predetermined number being set to a larger value when said combustion mode of said engine is set to said stratified combustion mode than when said combustion mode of said engine is set to said homogeneous combustion mode.

4. A control system according to claim 1, wherein when a load on said engine is outside a predetermined range, said desired torque-setting means sets said desired torque based on said required torque instead of said smoothed required torque.

5. A control system according to claim 1, wherein said operating condition detection means includes at least one of an engine rotational speed sensor for detecting a rotational speed of said engine and an accelerator pedal sensor for detecting a degree of accelerator pedal opening.

6. A control system according to claim 1, wherein said engine includes a plurality of cylinders, and a plurality of fuel injection valves each permitting injection of fuel into a combustion chamber of a corresponding one of said cylinders, and wherein said combustion mode of said engine is switched between said stratified combustion mode and said homogeneous combustion mode by changing timing of said injection of said fuel into said combustion chamber.

* * * * *